US006604447B2

(12) United States Patent
Iizuka et al.

(10) Patent No.: US 6,604,447 B2
(45) Date of Patent: Aug. 12, 2003

(54) SWASH PLATE-TYPE VARIABLE DISPLACEMENT COMPRESSOR

(75) Inventors: Jiro Iizuka, Isesaki (JP); Yuujirou Morita, Isesaki (JP)

(73) Assignee: Sanden Corporation, Gunma (JP)

( * ) Notice: Subject to any disclaimer, the term of this patent is extended or adjusted under 35 U.S.C. 154(b) by 79 days.

(21) Appl. No.: 09/982,909

(22) Filed: Oct. 22, 2001

(65) Prior Publication Data

US 2002/0053281 A1 May 9, 2002

(30) Foreign Application Priority Data

Nov. 8, 2000 (JP) ..... 2000-340329

(51) Int. Cl.[7] ..... F01B 3/00
(52) U.S. Cl. ..... 92/12.2; 92/71
(58) Field of Search ..... 92/12.2, 71; 91/504, 91/505; 74/839; 417/222.1, 222.2

(56) References Cited

U.S. PATENT DOCUMENTS 3,861,829 A * 1/1975 Roberts et al. ..... 417/222.2
4,664,604 A 5/1987 Terauchi
4,865,523 A 9/1989 Kikuchi et al.
4,872,815 A 10/1989 Takai
5,055,004 A * 10/1991 Ebbing et al. ..... 92/12.2
5,259,736 A 11/1993 Terauchi
5,282,725 A 2/1994 Shimizu
5,370,503 A 12/1994 Terauchi
5,425,303 A 6/1995 Shimizu et al.
6,158,968 A 12/2000 Nakamura
6,179,571 B1 * 1/2001 Kawachi et al. ..... 92/12.2
6,179,572 B1 1/2001 Taguchi

* cited by examiner

*Primary Examiner*—Edward K. Look
*Assistant Examiner*—Michael Leslie
(74) *Attorney, Agent, or Firm*—Baker Botts L.L.P.

(57) ABSTRACT

A swash plate-type, variable displacement compressor according to the present invention has a structure wherein the shoe holding portion of the piston sandwiches the swash plate from inside. The swash plate is connected to the rotor by a pin which extends in a direction tangential to a surface of a virtual cylinder around an axis of the drive shaft so as to be capable of swinging with respect to the pin. Especially, the position of the pin in the axial direction of the drive shaft is selected, so that a piston top clearance of a piston which is in a top dead center position becomes zero. By this configuration, the piston top clearance of all the pistons may be maintained at zero for all oblique angles of the swash plate. As a result, for any oblique angle, the volumetric efficiency of the compressor may be improved.

9 Claims, 6 Drawing Sheets

SWASH PLATE-TYPE VARIABLE DISPLACEMENT COMPRESSOR

BACKGROUND OF THE INVENTION

1. Field of the Invention

The present invention relates to a swash plate-type, variable displacement compressor for use in vehicular air conditioning apparatus. More particularly, this invention relates to a swash plate-type, variable displacement compressor that maintains piston top clearance at substantially zero over a whole range of oblique angles of swash plate.

2. Description of Related Art

In FIG. 1, a known swash plate-type, variable displacement compressor 100 used in vehicular air conditioning apparatus is shown. A cashing of the compressor 100 includes a front housing 102, a cylinder block 101 and a cylinder head 103. A drive shaft 106 is provided which passes through the center of front housing 102 and cylinder block 101. Drive shaft 106 is rotatably supported by front housing 102 and cylinder block 101 via bearings 107*a* and 107*b*. In cylinder block 101, a plurality of cylinder bores 108 are provided equiangularly around an axis XO of drive shaft 106. In each of cylinder bores 108, a piston 109 is slidably disposed. Pistons 109 are capable of reciprocation along axes parallel to the axis X0.

A rotor 110 is fixed to drive shaft 106, so that rotor 110 and drive shaft 106 may rotate together. Rotor 110 has an arm 117, and a hole 117*a* having an axis oblique to the axis X0 is provided in a terminal portion of arm 117. Front housing 102 and cylinder block 101 cooperatively define a crank chamber 105. Within crank chamber 105, a swash plate 111 having a penetration hole 120 at its center portion is accommodated, and drive shaft 106 penetrates through swash plate 111. Penetration hole 120 of swash plate 111 has a complex shape so as to enable changes in the oblique angle of swash plate 111 with respect to the axis X0. A bracket 115 is provided on the front housing-side surface of swash plate 111, and a guide pin 116 is fixed to a terminal portion of bracket 115. A spherical part 116*a* provided on the top of guide pin 116 is slidably fitted into hole 117*a*. Because spherical part 116*a* moves within hole 117*a*, the oblique angle of swash plate 111 may vary with respect to the axis XO. Hereafter, this connection mechanism including arm 117 of rotor 110, hole 117*a*, and guide pin 116, is labeled K. The circumferential portion of swash plate 111 has a shape of plane ring and is connected slidably to tail portions of pistons 109 via pairs of shoes 114.

When drive shaft 106 is driven by an external power source (not shown), rotor 110 also rotates around the axis XO together with drive shaft 106. Swash plate 111 also is made to rotate by rotor 110 via connection mechanism K. Simultaneously with the rotation of swash plate 111, the circumferential portion of swash plate 111 exhibits a wobbling motion. Only a component of the movement of the wobbling, circumferential portion of swash plate 111 in the axial direction parallel to the axis XO is transferred to pistons 109 via sliding shoes 114. As a result, pistons 109 are made to reciprocate within cylinder bores 108. Finally, in the operation of a refrigeration circuit, the refrigerant may be introduced repeatedly from an external refrigeration circuit (not shown) into a compression chamber, which is defined by the piston top of piston 109, cylinder bore 108, and valve plate 104, via suction chamber 130. The refrigerant then may be compressed by reciprocating piston 109, and the refrigerant subsequently may be discharged to the external refrigeration circuit via discharge chamber 131.

However, known compressors, such as that shown in FIG. 1, may exhibit several deficiencies. First, there may be a problem of controlling piston top clearance. Second, in such known compressors, because the frictional resistance against the inclining movement of swash plate 111 is large, changes in the oblique angel of the swash plate are not smooth. Third, there may be a problem with vibration of the compressor.

With reference to FIG. 1, the center of changes in the oblique angle of swash plate 111 is located at point Z. When the oblique angle of swash plate 111 changes, a resistant force is created due to frictional contact of spherical part 116*a* and the inner surface of hole 117*a*. The distance between the contact point of spherical part 116*a* and the inner surface of hole 117*a* and the center of changes in the oblique angle of the swash plate is relatively large. As a result, the resistant force due to the frictional contact of spherical part 116*a* and hole 117*a* impedes smooth changes to the oblique angle of swash plate 111.

With further reference to FIG. 1, the swash plate may be designed so as to have a center of gravity located on the axis XO when the oblique angle of the swash plate is minimized. The center of gravity of the swash plate deviates from the axis XO as the oblique angle of the swash plate increases. As the oblique angle of the swash plate increases, the distance between the center of gravity of the swash plate and the axis increase monotonically. Thus, as the oblique angle of the swash plate increases, the degree of unbalance due to the shift in the center of gravity of the swash plate also increases monotonically. As a result, a vibration of the whole compressor occurs during operation due to that unbalance.

SUMMARY OF THE INVENTION

A need has arisen to provide a swash plate-type, variable displacement compressor having a connection mechanism between the rotor and the swash plate that keeps the piston top clearance substantially zero over a whole range of oblique angles of the swash plate. It is a technical advantage of the present invention that the compressor may maintain the dead volume at substantially zero by keeping the piston top clearance at about zero over the range of oblique angles of the swash plate. Thus, the volumetric efficiency of the compressor is improved. A further need has arisen to provide a connection mechanism between the rotor and the swash plate, such that the impeding, frictional force acting against the inclining movement of the swash plate is suppressed. It is a further technical advantage of the compressor that the inclining movement of the swash plate becomes smooth, and the responsiveness of the compressor to changes in demanded capacity improves. An additional need has arisen to provide a swash plate, the center of gravity of which shifts less from the axis of the drive shaft than that of known compressors, when the oblique angle of the swash plate is changed. It is an additional technical advantage of such compressors that the vibration of the whole compressor due to an unbalanced center of gravity of the swash plate with regard to the axis of the drive shaft, may be reduced.

In an embodiment of the invention, a swash plate-type, variable displacement compressor comprises a front housing, a cylinder block, and a cylinder head. A drive shaft is supported rotatably by the front housing, and the cylinder block. A rotor is fixed to the drive shaft so as to be rotatable with the drive shaft. A plurality of pistons are accommodated slidably in a corresponding plurality of cylinder bores which are provided and arranged through an end surface of the cylinder block, and axes of the cylinder bores are arranged about a virtual cylinder having a radius R and formed around an axis X of the drive shaft. A central portion the drive shaft penetrates through a swash plate, and each of the pistons is connected to the swash plate via a pair of shoes. A connection mechanism is operably connected between the rotor and the swash plate, and the connection mechanism enables the swash plate to change its oblique angle with respect to the axis X of the drive shaft. The swash plate comprises a flat ring and a second ring, and the pistons are connected to the flat ring from inside. The connection mechanism further comprises a first arm and a second arm provided on the rotor, a pin, and a third arm formed on the swash plate. The pin extends in a direction tangential to the surface of the virtual cylinder.

Other objects, features, and advantages of this invention will be understood from the following description of preferred embodiments with reference to the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 2:
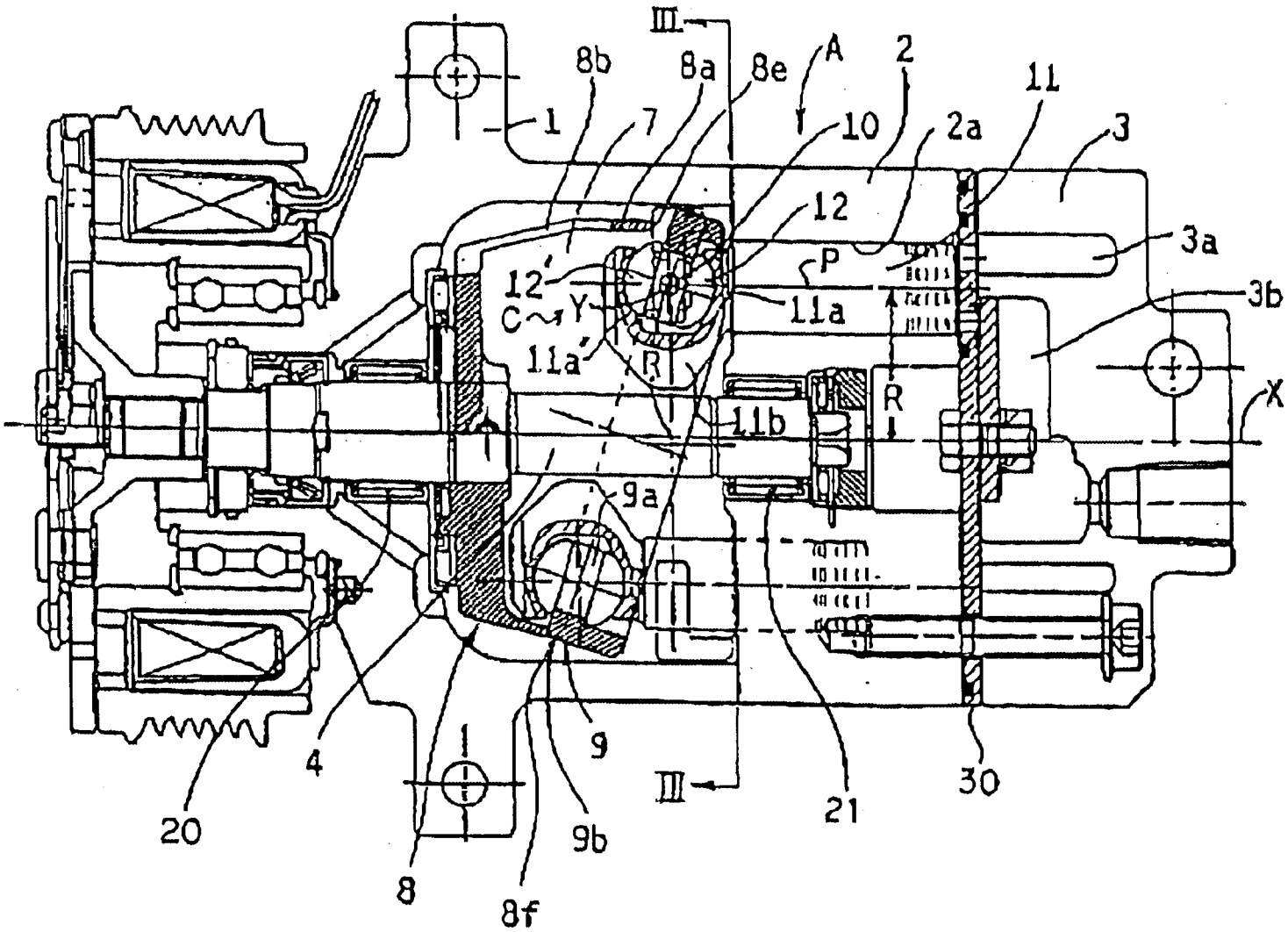
FIG. 2 is a cross-sectional view of a swash plate-type, variable displacement compressor according to the present invention.
Figure 3:
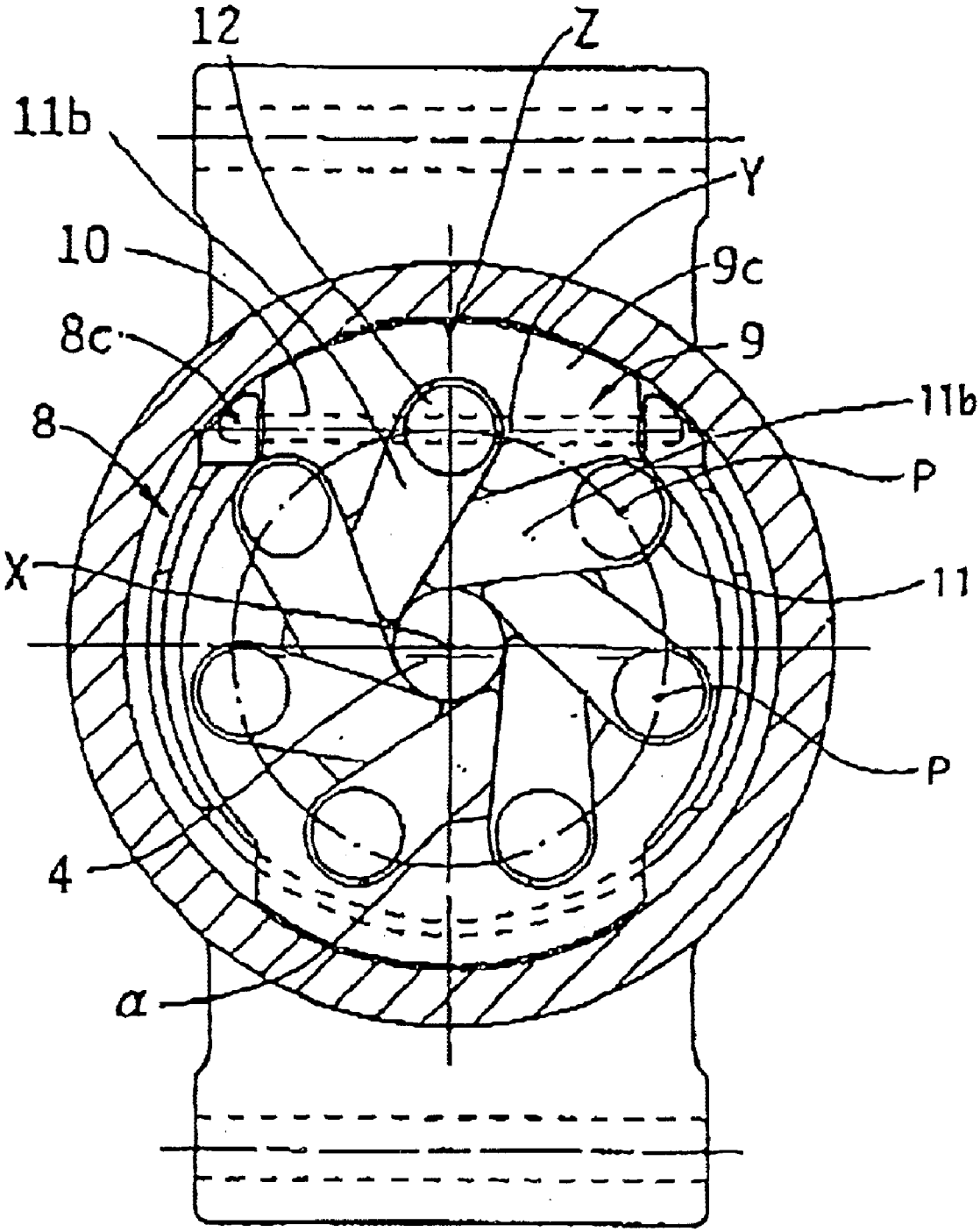
FIG. 3 is a cross-sectional view along the line III—III in FIG. 2.

FIG. 2 depicts a swash plate-type, variable displacement compressor A according to the present invention. The casing of compressor A comprises a front housing 1, a cylinder block 2, and a cylinder head 3. A drive shaft 4 is provided which passes through the center of front housing 1 and cylinder block 2. Drive shaft 4 is rotatably supported by front housing 1 and cylinder block 2 via bearings 20 and 21. In cylinder block 2, a plurality of cylinder bores 2*a* are provided equiangularly around an axis X of drive shaft 4, as shown in FIG. 3. In each of cylinder bores 2*a*, a piston 11 is slidably disposed. Pistons 11 are capable of reciprocation along axes parallel to axis X.

A rotor 8 is fixed to drive shaft 4, such that rotor 8 rotates together with drive shaft 4. A swash plate 9 is connected to rotor 8 via a pin 10 which extends in a direction perpendicular to the plane of FIG. 2. Swash plate 9 may swing around pin 10. This connection mechanism is identified by the letter C.

Figure 4:
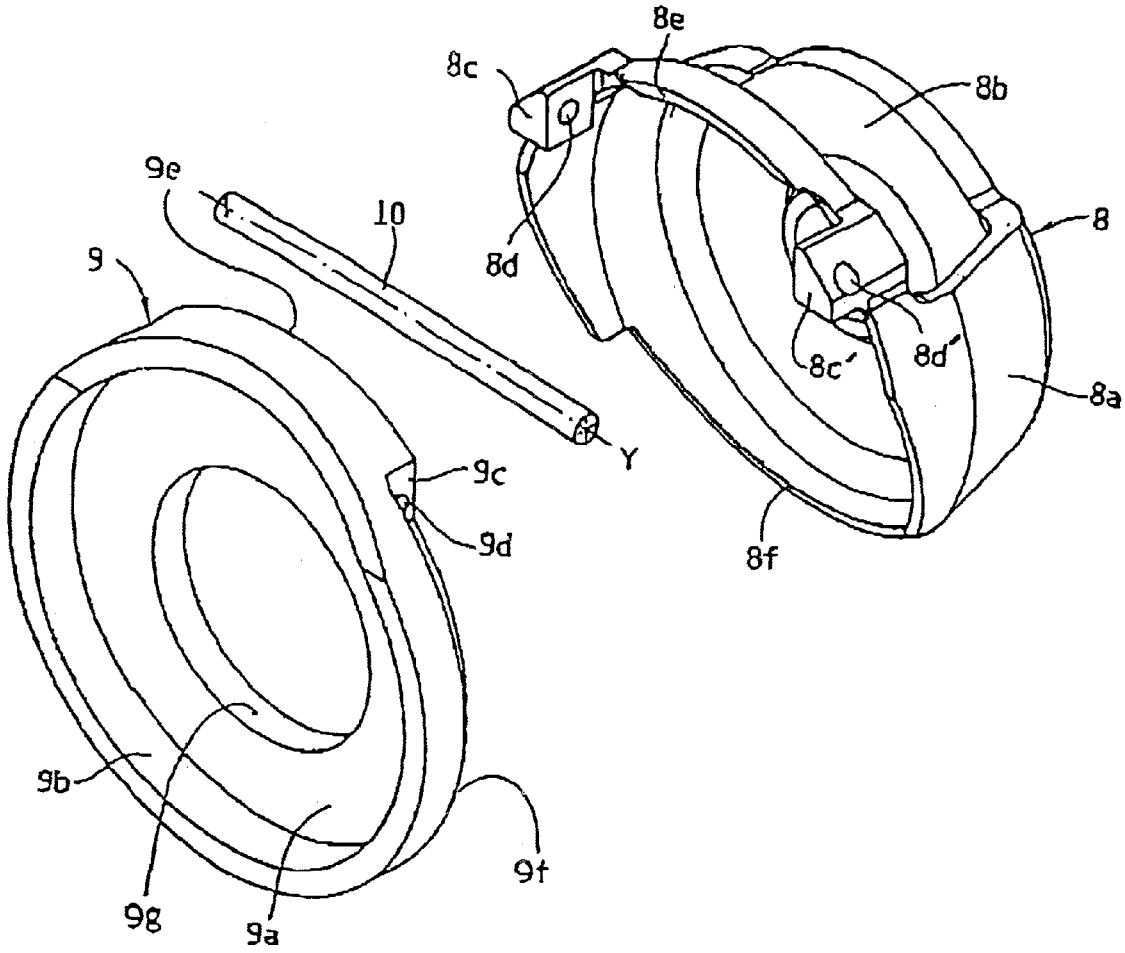
FIG. 4 is a perspective, exploded view of the connection mechanism between the rotor and the swash plate of the compressor shown in FIG. 2.

In FIG. 4, a detailed figure of rotor 8 and swash plate 9 is depicted. Rotor 8 has generally an obliquely cut cup shape. A hole 8*b* for balancing rotor 8 is provided in a side wall 8*a* of rotor 8. At two positions on side wall 8*a*, a first arm 8*c* and a second arm 8*c'* are formed. In each arm 8*c* and 8*c'*, a hole 8*d* is formed to allow pin 10 to pass therethrough. An end surface 8*e* between arms 8*c* and 8*c'* limits the minimum oblique angle of swash plate 9. An opposite end surface 8*f* limits the maximum oblique angle of swash plate 9. The axial line of pin 10 is identified by the letter Y.

Rotor 9 comprises a flat ring 9*a* having a central hole 9*g* and a second ring, e.g., a short, cylinder-shaped ring 9*b* which adjoins flat ring 9*a*. Ring 9*b* may either be formed integrally with flat ring 9*a*, or may be a separate element attached to flat ring 9*a*. An outer peripheral part of flat ring 9*a* is cut away so as to form a third arm 9*c*. A hole 9*d* is provided in third arm 9*c* to allow pin 10 to pass therethrough. During assembly of compressor A, third arm 9*c* of swash plate 9 is inserted into the gap between the arms 8*c* and 8*c'*, and pin 10 then is inserted into one of hole 8*d*, hole 9*d*, and remaining hole 8*d'*. Pin 10 may be fixed to hole 9*d* or to the pair of holes 8*d* and 8*d'*. By this connection mechanism, swash plate 9 may swing around the axis Y. Thus, the minimum oblique angle of swash plate 9 is limited by contact between the end of surface 8*e* of rotor 8 and an upper flange 9*e* of swash plate 9. The maximum oblique angle of swash plate 9 is limited by contact between the other end surface 8*f* of rotor 8 and a lower flange 9*f* of swash plate 9.

Figure 5:
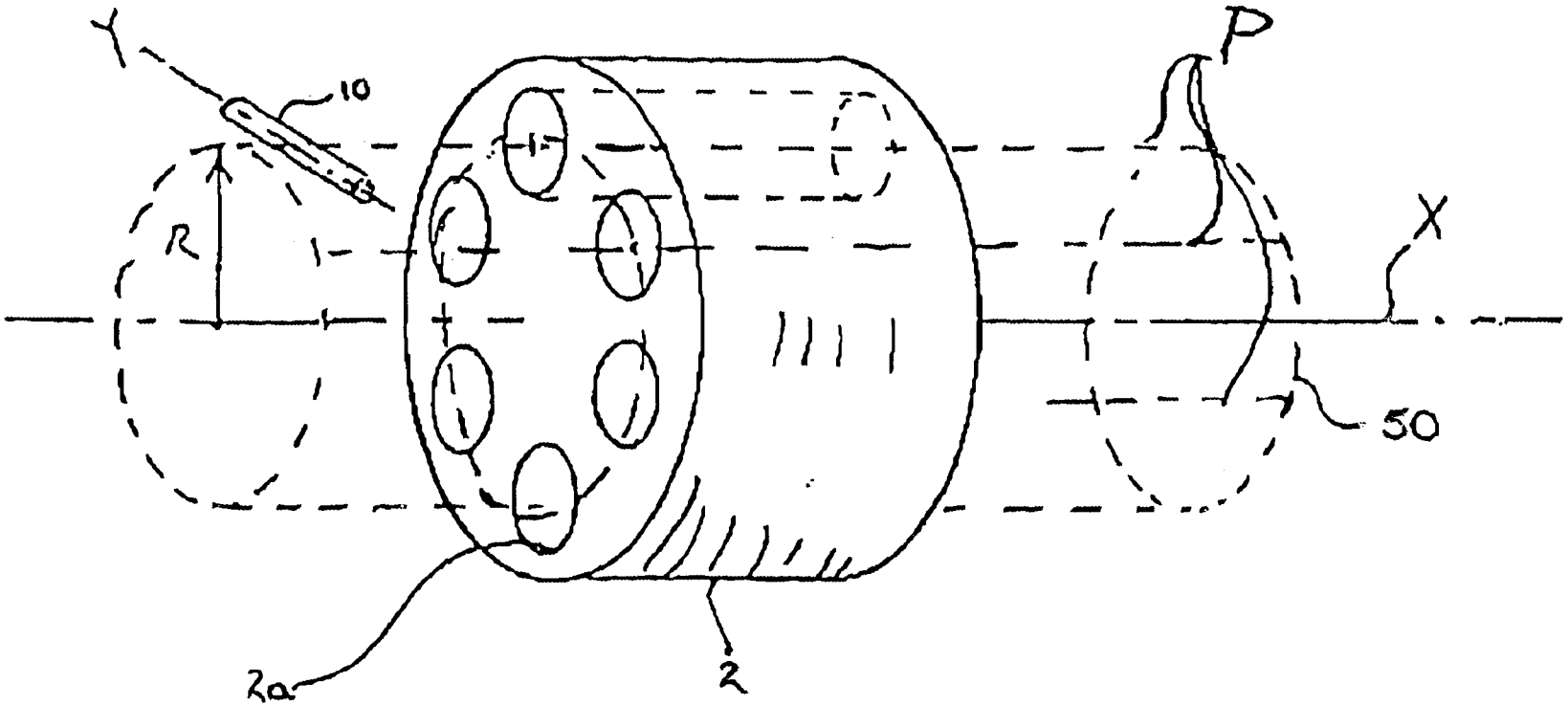
FIG. 5 depicts a virtual cylinder having a radius R and formed around axis X of a drive shaft.

With further reference to FIGS. 2 and 5, swash plate 9 is depicted in a maximum angle position with respect to the oblique angle of swash plate 9. Axes P of each of cylinder bores 2*a* (which also is the axis of each of pistons 11) are arranged within cylinder block 3 about a virtual cylinder 50 having a radius R and formed around axis X of drive shaft 4. Pin 10 is designed to be disposed in a direction tangential to a circumferential surface of virtual cylinder 50 at radius R around axis X of drive shaft 4. Although not shown in the figure, energizing means (e.g., a spring) for shifting swash plate 9 in the minimum angle direction may be disposed between rotor 8 and swash plate 9.

Piston 11 has a pair of shoe holding portions 11*a* and 11*a'* and an arm 11*b* which connects them. Flat ring 9*a* of swash plate 9 is sandwiched slidably by the pair of shoe holding portions 11*a* and 11*a'* via a pair of shoes 12 and 12'. A feature of this embodiment of invention is the presence of shoe holding portions 11*a* and 11*a'*, which engage with flat ring 9*a* from the inside.

The position of pin 10 in the X direction is designed so as to make a piston top clearance of piston 11, that is in a top dead center position, zero. By this design, the piston top clearance of a piston may be maintained at about zero independent of the oblique angle of swash plate 9.

Figure 1:
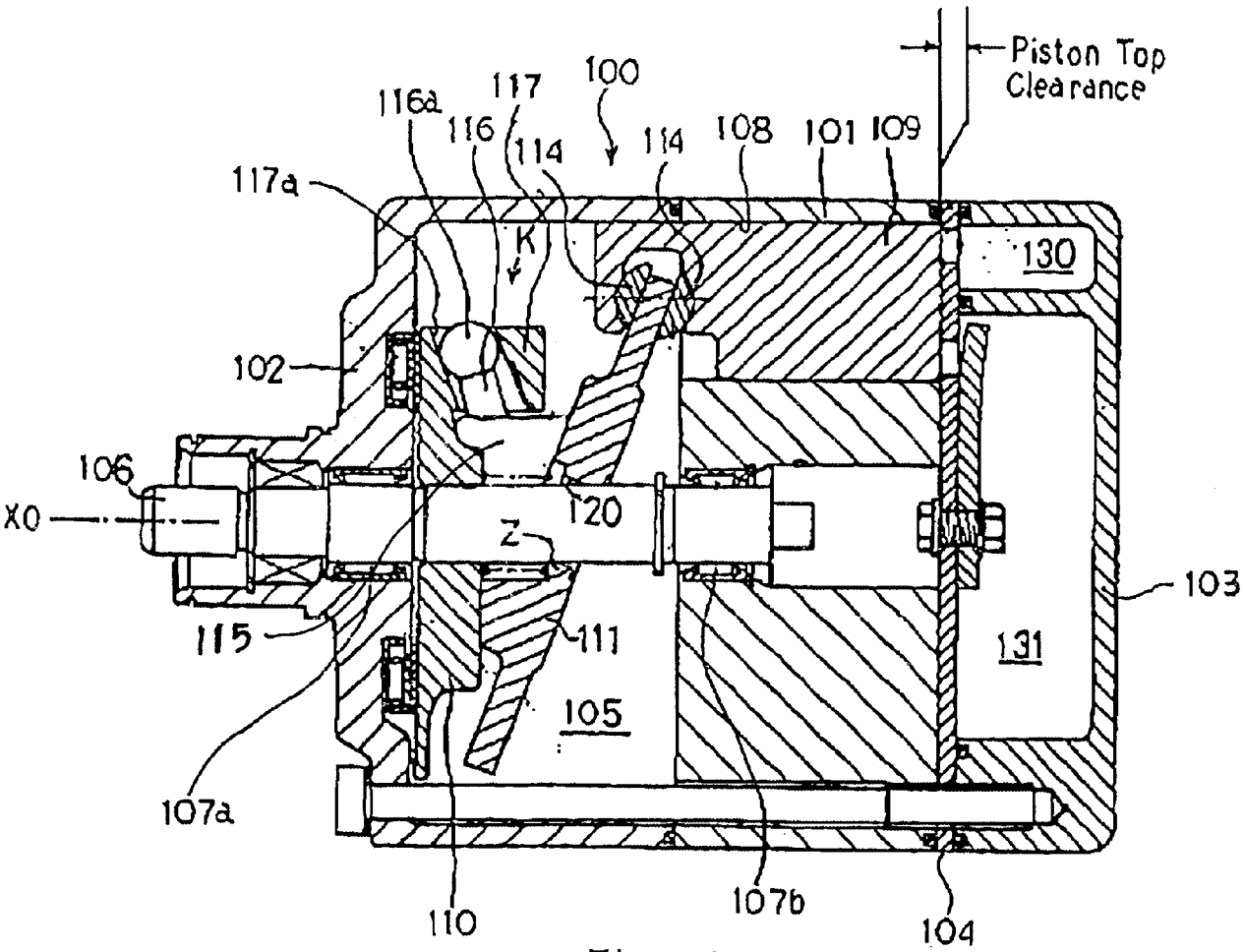
Fig. 1 (PRIOR ART)
FIG. 1 is a cross-sectional view of a known swash plate-type, variable displacement compressor.
Figure 7:
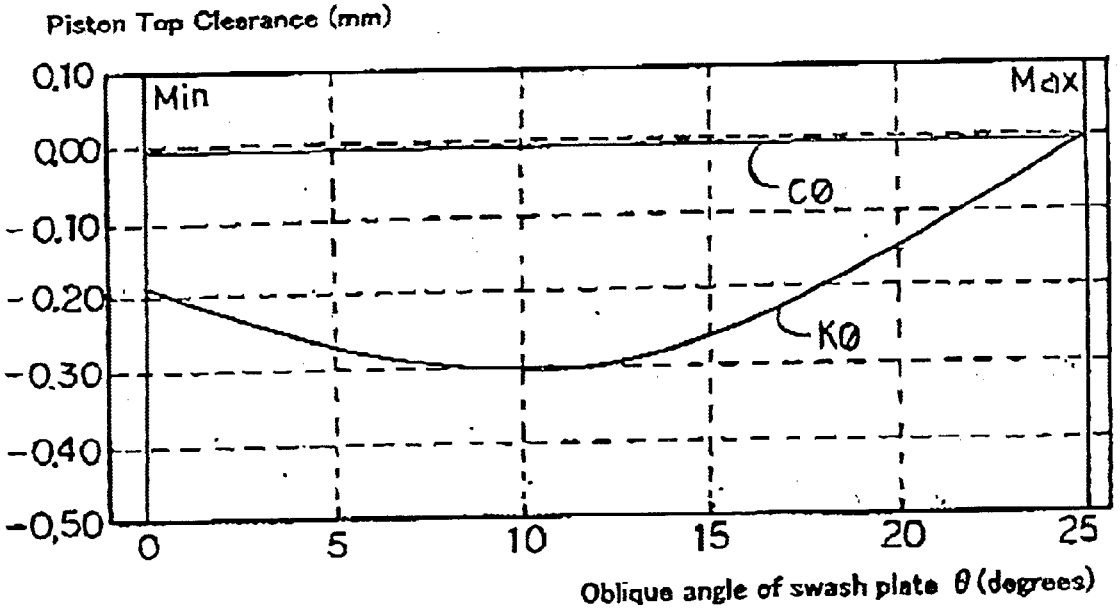
FIG. 7 is a graph showing relationships of piston top clearance and the oblique angle of the swash plate of a known compressor and of the compressor according to the present invention.

In known compressor of FIG. 1, variation of the piston top clearance with respect to changes in the oblique angle of the swash plate is large. The piston top clearance is a distance between the piston top of piston 109 and valve plate 104, when the piston is in a top dead center position. With reference to FIG. 7, a curve K0 shows a relationship between the oblique angle θ of swash plate 111 and a piston top clearance for connection mechanism K. In FIG. 7, the greater the negative value of the piston top clearance, the greater the gap between a piston top and valve plate 104 when the piston is in a top dead center position. As is known in the art, the greater the piston top clearance remains, the more the compressor's volumetric efficiency deteriorates. The greater is the piston top clearance; the greater is the dead volume in each cylinder. With reference to the curve K0, the most important range of the oblique angle of the swash plate is between about 5 degrees and about 20 degrees, and the curve K0 deviates considerably from the piston top clearance or the "0.00" line on FIG. 7. As a result, in known compressor 100 of FIG. 1, there remains a considerable dead volume for the important range of the oblique angle of swash plate 111. Thus, for a known connection mechanism K, the piston top clearance changes as a function of the oblique angle of the swash plate in an undesirable manner, so that there is a room for improving the volumetric efficiency of the compressor. With further reference to FIG. 7, the curve C0 displays the piston top clearance behavior of the compressor of the present invention having connection mechanism C over the entire range of oblique angles of the swash plate. As may be seen from the figure, compressor A according to the present invention may maintain piston top clearance at substantially zero for any value of oblique angle of the swash plate.

Referring again to FIG. 2, when drive shaft 4 is driven by an external power source (not shown), rotor 8 also rotates around axis X together with drive shaft 4. Swash plate 9 also is made to rotate by rotor 8 via connection mechanism C. Simultaneously, with the rotation of swash plate 9, flat ring 9*a* may exhibit wobbling motion. Nevertheless, only a component of movement in the axial direction of axis P of the wobbling flat ring 9*a* is transferred to the pistons 11 via sliding shoes 12. As a result, the pistons 11 are made to reciprocate within each of cylinder bores 2*a*. Finally, in operation a refrigeration circuits may repeatedly introduce refrigerant from an external refrigeration circuit (not shown) into a compression chamber such as that defined by the piston top of piston 11, cylinder bore 2*a*, and a valve plate 30 via a suction chamber, e.g., suction chamber 3*a*, and then compressing the refrigerant by a reciprocating piston, and discharging the refrigerant to the external refrigeration circuit via a discharge chamber, e.g., discharge chamber 3*b*. In addition, the oblique angle of the swash plate may be controlled by introducing refrigerant into the crank chamber and controlling the pressure in the crank chamber via a valve mechanism (not shown).

In FIG. 3, the relative disposition of arms 11*b* of pistons 11 is shown. During the operation of the compressor, each piston 11 rotates around its piston axis P within each cylinder bore 2*a*. In order to restrict this rotation, arm 11*b* of piston 11 is extended generally toward the X axis of drive shaft 4. The neighboring two arms 11*b* are in contact with each other slidably, and each arm 11*b* also is slidably in contact with drive shaft 4. By this configuration, the rotation of all pistons may be inhibited.

Referring again to FIG. 4, in the compressor of the present invention, swash plate 9 may swing around pin 10. The diameter of pin 10 is relatively thin, so that resistant force due to the friction between pin 10 and hole 8*d* or between pin 10 and hole 9*d* may not exert effective resistant force. Thus, the swing of swash plate 9 around pin 10 is not impeded, and, therefore, is smooth. As a result, the response of the compressor to capacity changes is improved.

Figure 6:
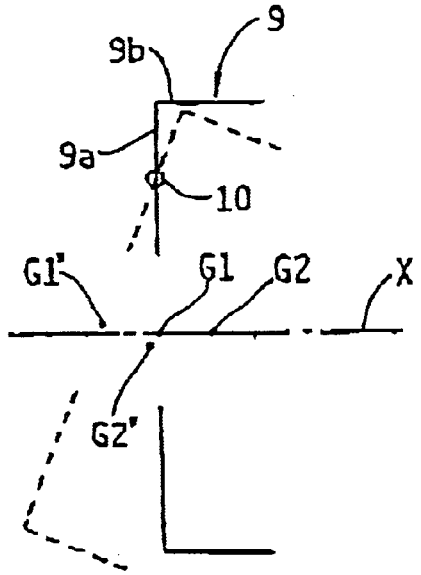
FIG. 6 is a schematic illustration showing a displacement of the center of gravity of the swash plate of the compressor shown in FIG. 2.

In FIG. 6, a function of ring 9*b* of swash plate 9 is shown schematically. Swash plate 9 comprises flat ring 9*a* and second ring 9*b*. The center of gravity of flat ring 9*a* is indicated by an alpha-numeric symbol G1. The center of gravity of ring 9*b* is indicated by an alpha-numeric symbol G2. A center of gravity of entire swash plate 9 is located generally at a middle point between the G1 and G2. When the oblique angle of swash plate 9 is zero, both G1 and G2 are on the axis X. In that case, there is no unbalance. However, when swash plate comprises only flat plate 9*a*, the oblique angle of swash plate is increased, and G1 shifts to a new position G1', which is above axis X. Thus, in this situation, an unbalance occurs. However, swash plate 9 comprises flat ring 9*a* and second ring 9*b*. When the oblique angle of the swash plate is increased, the G2 shifts to a new position G2' which is below axis X. The resultant middle point between the G1' and G2' does not depart significantly from the axis X. Therefore, there occurs little unbalance. Thus, ring 9*b* functions to suppress the occurrence of an unbalance of the center of gravity of the entire swash plate when the oblique angle of the swash plate increases. Consequently, by this configuration, the vibration of the compressor may be reduced effectively.

Thus, by employing connection mechanism C and by selecting the position of the pin in axial direction appropriately, the compressor according to the present invention may suppress the vibration, improve the capacity change response, and improve the volumetric efficiency of the compressor for any value of oblique angle of the swash plate.

Although the present invention has been described in detail in connection with preferred embodiments, the invention is not limited thereto. It will be understood by those skilled in the art that variations and modification may be made within the scope of this invention, as defined by the following claims.

We claim:

1. A swash plate-type, variable displacement compressor comprising:

a front housing;

a cylinder block;

a cylinder head;

a drive shaft rotatably supported by said front housing and said cylinder block;

a rotor fixed to said drive shaft so as to be rotatable with said drive shaft; a plurality of pistons slidably accommodated in a corresponding plurality of cylinder bores which are provided and arranged through an end surface of said cylinder block, and axes of said cylinder bores are arranged about a virtual cylinder having a radius R and formed around an axis X of said drive shaft;

a swash plate through which a central portion said drive shaft penetrates and to which is connected each of said pistons via a pair of shoes;

a connection mechanism operably connected between said rotor and said swash plate, which enables said swash plate to change its oblique angle with respect to said axis X of said drive shaft; and said swash plate comprising a flat ring and a second ring wherein;

said pistons are connected to said flat ring from inside; and said connection mechanism comprises a first arm and a second arm provided on said rotor, a pin, and a third arm formed on said swash plate, wherein said pin extends in a direction tangential to surface of said virtual cylinder.

2. The compressor of claim 1, wherein the position of said pin in a direction parallel to said axis X is selected, so that a piston top clearance of said piston is zero at a top dead center position when an axis Y of said pin arrives at a position at which it intersects the axis of that piston.

3. The compressor of claim 1, wherein an arm which connects a shoe holding portion of said piston extends generally toward said axis X, and which makes slidable contact with said arms of said pistons.

4. The compressor of claim 1, wherein an arm which connects a shoe holding portion of said piston extends generally toward said axis X, and which makes slidable contact with said drive shaft.

5. The compressor of claim 1, wherein said rotor has an obliquely cut, cup shape.

6. The compressor of claim 1, wherein said ring of said swash plate is formed integrally with said flat ring.

7. The compressor of claim 1, wherein said second ring of said swash plate is formed separately from said flat ring.

8. The compressor of claim 1, wherein means for shifting said swash plate to reduce the oblique angle between said swash plate and said drive shaft are disposed between said rotor and said swash plate.

9. The compressor of claim 1, wherein the minimum oblique angle of said swash plate is limited by contact between a first end surface of said rotor and an upper flange of said swash plate; and the maximum oblique angle of said swash plate is limited by contact between a second end surface of said rotor and an lower flange of said swash plate.

* * * * *

UNITED STATES PATENT AND TRADEMARK OFFICE

CERTIFICATE OF CORRECTION

PATENT NO. : 6,604,447 B1
DATED : August 12, 2003
INVENTOR(S) : Jiro Iizuka et al.

It is certified that error appears in the above-identified patent and that said Letters Patent is hereby corrected as shown below:

Title page,
Item [*] Notice, should read -- Subject to any disclaimer, the term of this patent is extended or adjusted under 35 U.S.C. 154(b) by 114 days. --

Signed and Sealed this

Eleventh Day of May, 2004

JON W. DUDAS
*Acting Director of the United States Patent and Trademark Office*